US005323982A

United States Patent [19]

Ligon et al.

[11] Patent Number: 5,323,982

[45] Date of Patent: Jun. 28, 1994

[54] LOW PROFILE YARN SUPPLY APPARATUS FOR A LOOM HAVING PNEUMATIC YARN THREADING

[76] Inventors: Lang S. Ligon, P.O. Box 5578, Station B; Joe Wright, Jr., P.O. Box 6763, both of Greenville, S.C. 29606

[21] Appl. No.: 2,238

[22] Filed: Jan. 8, 1993

[51] Int. Cl.[5] ..... B65H 49/10; B65H 49/14

[52] U.S. Cl. ..... 242/131; 139/450

[58] Field of Search ..... 242/131, 131.1, 130; 139/450

[56] References Cited

U.S. PATENT DOCUMENTS

| | | | |
|---|---|---|---|
| 3,151,021 | 9/1964 | Balch | 242/131 X |
| 3,625,453 | 12/1971 | Furst | 242/131 |
| 3,693,904 | 9/1972 | Bucher | 242/131 |
| 4,545,547 | 10/1985 | Singer | 242/131 |
| 4,572,458 | 2/1986 | Bluhm et al. | 242/131 |
| 4,784,349 | 11/1988 | Renwick et al. | 242/131 |
| 4,836,468 | 6/1989 | Singer | 242/131 |
| 4,865,264 | 9/1989 | Goineau | 242/131 |
| 5,024,393 | 6/1991 | Gutschmit | 242/131 |

FOREIGN PATENT DOCUMENTS

| | | | |
|---|---|---|---|
| 0153800 | 2/1982 | Fed. Rep. of Germany | 242/131 |
| 300548 | 8/1954 | Sweden . | |
| 1370915 | 10/1974 | United Kingdom | 242/131 |

*Primary Examiner*—Stanley N. Gilreath

*Attorney, Agent, or Firm*—Cort Flint; Henry Jaudon

[57] ABSTRACT

A weft supply system for a loom having a support frame with vertically extending support beams interconnected with substantially horizontal and vertically separated rods which form a plurality of vertically aligned creel support levels. Creel mounting means are provided on an upper surface of certain of the horizontal rods and a multi-bobbin creel is mounted by each of the creel mounting means. The weft yarn supply system includes yarn delivery apparatus associated with each creel support level. The yarn delivery apparatus includes a pneumatic threading system for threading the weft yarn through the yarn delivery apparatus.

33 Claims, 3 Drawing Sheets

LOW PROFILE YARN SUPPLY APPARATUS FOR A LOOM HAVING PNEUMATIC YARN THREADING

BACKGROUND OF THE INVENTION

This invention relates to a compact weft yarn supply system for use with looms which weave multi-color weft yarn from a stationary supply. The invention is, however, not so limited and is adaptable for use with any textile yarn processing system.

The need for supplying multiple colors of yarns to a loom has resulted in the provision of multi-tier creels. However, the vertical height of such creels has made it difficult for the loom attendant to service the uppermost creels. Furthermore, the height makes it difficult to thread up the yarn supply packages.

The use of pneumatic threading arrangements for threading the yarns supplied from an end structure to a loom is known. One such arrangement is shown in U.S. Pat. No. 3,303,982 where the vertical creel arrangement is provided with flexible guide tubes which deliver the yarn from the creel to an expander. Air, under pressure, is delivered to an end of the guide tube adjacent its end associated with the yarn supply bobbin to draw the yarn end through the guide tube. U.S. Pat. No. 5,024,393 shows another pneumatic yarn threading arrangement for threading yarns through a transport tube of a yarn creel. Here a tube supporting arrangement is provided in spaced horizontal relationship with the bobbin support apparatus. An air supply is arranged adjacent the entry end of each tube and the yarn is forced through the tube by a blast of compressed air into the entry end. both these arrangements are bulky in structure and may not transport the yarn in a totally satisfactory manner.

U.S. Pat. Nos. 3,693,904; 4,572,458 and 4,865,264 disclose yarn supply creel arrangements in which the supply bobbins are arranged with their axes extending along horizontal planes. U.S. Pat. No. 3,693,904 is not directed to a creel in which supply bobbin are vertically stacked. U.S. Pat. Nos. 4,572,458 and 4,865,264 are each directed to a single rotatable creel having a plurality of vertically arranged bobbin support locations. None of the references teach vertically stacked creel support compartments.

Accordingly, an object of this invention is to provide a compact yarn supply system having a compact vertical height.

Another object of the invention is to provide a yarn supply system capable of supplying up to six different colored or textured yarns to a processing machine.

Another object of the invention is to provide yarn creels which are mobile so as to provide ease of re-supply.

Another object of the invention is to provide a yarn supply system which includes delivery apparatus which delivers the yarn from the supply system in a protected condition.

Another object of the invention is to provide a thread-up system for the delivery apparatus which is both economical and dependable.

According to the invention, the yarn packages are supported on a vertical frame by vertically aligned creels. Each creel mounts a plurality of yarn packages or bobbing so that the axis of each bobbin is disposed along substantially a horizontal plane. Each creel may support your packages of a single color or of two colors.

There is provided a yarn guide system for each color yarn. The guide system includes a pneumatic threading system which allows for quick threading up of the yarn in the guide system. From the guide system, the yarn is delivered to the fabricating machine.

SUMMARY OF THE INVENTION

The above objectives are accomplished according to the present invention by providing a yarn supply system for supplying yarn to a textile fabricating machine which includes a creel having means which mount a plurality of yarn carrying bobbins along a substantially horizontal plane. The bobbins are arranged so that a horizontal axis passing along the axes of each bobbin intersects at a point along a vertical axis disposed centrally of the creel and intermediate of the bobbin. Yarn delivery apparatus is arranged to deliver a single yarn from the creel to the fabricating machine. The yarn delivery apparatus includes a support housing disposed along the vertical axis. The housing is formed with a through bore which mounts a second end of a first tube and a first end of a second tube. The ends are disposed substantially at right angles to each other. The first tube is also arranged to extend along the vertical axis with its first end arranged to be substantially coplanar with the intersection of the horizontal axes. The second tube is arranged so that its second end is disposed to deliver the yarn away from the supply system and to the fabricating machine. The yarn delivery apparatus includes an inlet tube arranged to merge with the second tube along its length in the vicinity of its second end. Piping and control apparatus are provided to connect the inlet tube with a supply of pressurized air. In operation, the release of the pressurized air through the inlet tube and out the second end of the second tube creates a venturi effect which draws air through the first end of the first tube, through the first tube, through the housing and the second tube out the second end of the second tube with sufficient force to entrain the thread and propel it through the delivery apparatus.

The creel is supported by a frame which includes spaced vertical beams and at least one interconnecting horizontal rod. The creel is mounted on and above the horizontal rod. The creel may be rotatably mounted. Also, there may be a plurality of horizontal rods each mounting a creel. Each creel mounts a yarn deflector plate. Also, each horizontal rod mounts a horizontally disposed yarn deflector shield. The deflector shields act to separate the creels into compartments. The yarn delivery apparatus is mounted on a deflector shield with its first tube extending below the deflector shield and its second tube extending above the deflector shield. The deflector shield is provided with an opening in which the housing is positioned to extend above and below the deflector. A lower flange surface of the housing cooperates with a ring formed on and adjacent the first end of the first tube to lock the yarn delivery apparatus in position. The first tube of the yarn delivery apparatus is provided with a ceramic eyelet in its first and second ends. Also, the second end of the second tube of the yarn delivery apparatus is provided with a ceramic eyelet. These eyelets function as the sole support surfaces for the yarn when passing through the delivery apparatus during delivery to the fabricating machine. The piping and control apparatus connecting the inlet tube with a supply of pressurized air includes a supply line connected to a regulating supply tank. A valve member associated with each yarn delivery apparatus controls release of the air from the supply tank. Actuation of the valve releases compressed air through the inlet tube and the second end of the second tube. The regulating apparatus controls the air pressure in the regulating supply tank.

The weft supply system has a support frame with vertically extending support beams interconnected with substantially horizontal and vertically separated rods which form a plurality of vertically aligned creel support levels. A creel mounting pin is secured to an upper surface of certain of the horizontal rods and a multi-bobbin creel is mounted about each of the creel mounting pins. Certain of the creel support levels are arranged to rotatably mount the creels and certain other creel support levels mount the creels in a non-rotatory manner. The levels are separated by the horizontally disposed yarn deflector shield and each of the yarn delivery apparatus is mounted above its associated creel by one of the deflector shields. Each creel is provided with bobbin support members which are disposed about outer edge areas of the creel. The bobbin support members mount weft yarn supply bobbins to face inwardly.

Certain creels mount four yarn supply bobbins carrying weft yarn of a single color. The yarn supply bobbins extend along a horizontal plane and lines drawn along their axis merge at a center point. First vertically extending tube has a yarn receiving opening disposed adjacent the center point. Certain other of the creels mount four weft yarn bobbins carrying yarn of at least two colors. The weft supply bobbins are mounted in pairs to extend along a horizontal plane. The weft yarn bobbins carrying yarns of the same color are arranged with their ends in opposed relationship and the delivery system is disposed between each pair of bobbins carrying weft yarns of matched color.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
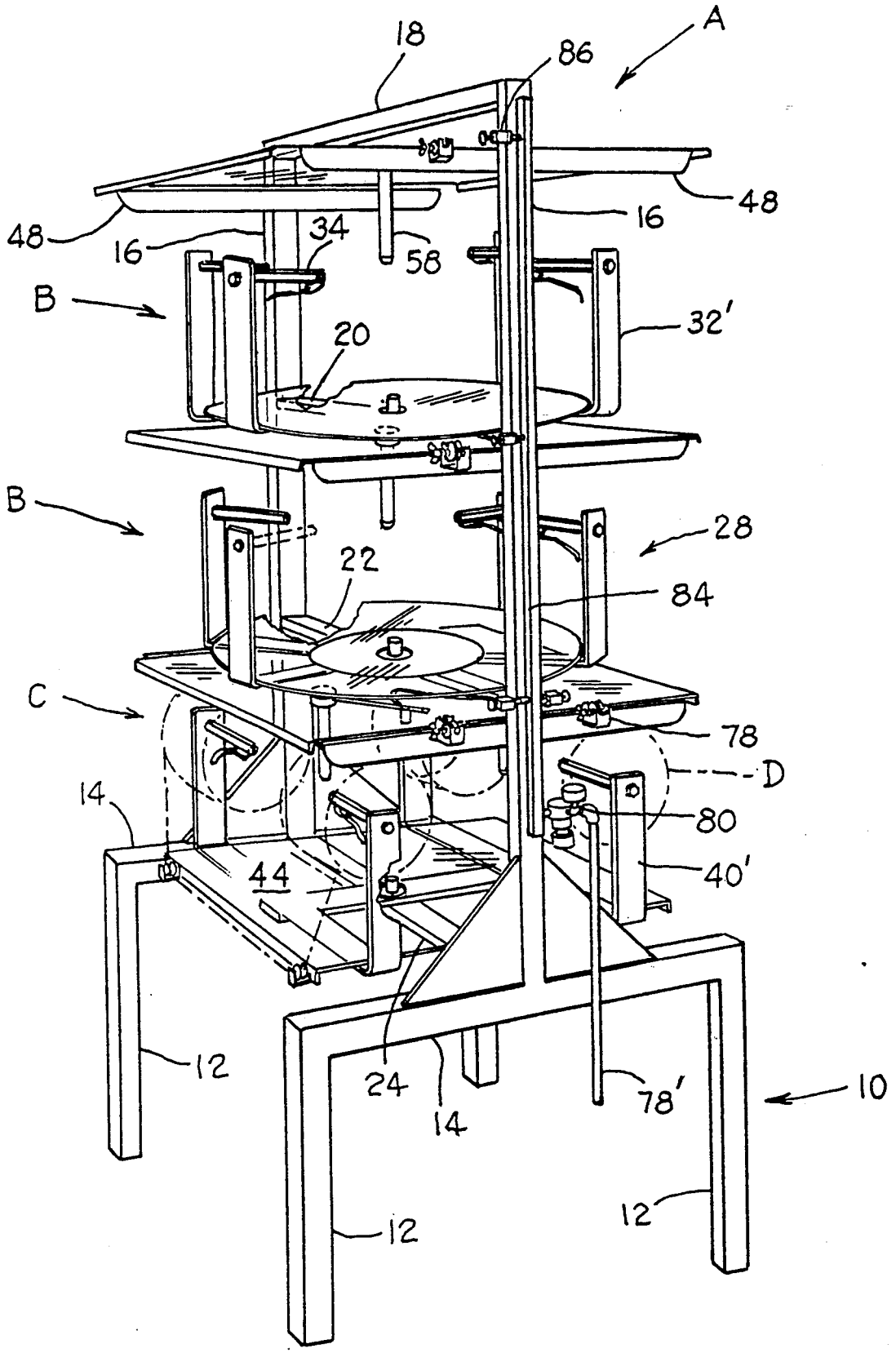
FIG. 1 is a perspective view of the yarn supply system.

The yarn supply arrangement of the present invention is best shown in FIG. 1 wherein frame A is shown as having a support 10 consisting of opposed pairs of vertical legs 12 interconnected with a pair of transverse support beams 14. A vertical beam 16 is secured intermediate the upper surface of each support beam 14. Four transverse rods 18, 20, 22 and 24 are secured to inner surfaces of vertical beams 16 at spaced vertical locations. Transverse rods 18, 20, 22, and 24 define vertically spaced creel support areas B and C. Viewing now FIGS. 1 and 2, transverse rods 22, 24 define lower creel support area or compartment C while transverse rods 18, 20, 22 define an intermediate and upper creel support areas or compartments B.

Centrally of and on the upper side of rods 20, 22 and 24 there is formed a vertically disposed creel support pin 26. A bobbin supporting creel 28 is supported on transverse rods 20 and 22 about pin 26 in such a manner as to be rotatable about the pin. Creel 28 consists of four horizontal arms 32 arranged along a single plane and interconnected at a first end to bearing member 30. Arms 32 are equally spaced about bearing 30 and shaped so that their opposite ends 32' extend along vertical planes. Bobbin supports 34, of known design are secured to opposite ends 32' of arms 32 and are arranged so that they extend along horizontal planes. Bobbin supports 34 are also arranged so that a center line drawn along an axis of a first one of supports 34 extends also along the axis of a second and opposed support 34. Also, a line drawn along the vertical axis of pins 26 is intersected at a single point by the horizontal lines along the axis of supports 34. Supply bobbins carried on the supports likewise have a common center axis. Both creels 28 for the creel support areas B are designed to supply bobbins D carrying the same color or type yarns and are constructed to mount the bobbins in a circular arrangement.

Creel 36 which is positioned within creel support area C is designed to carry bobbing D carry supply yarns of two colors or types. Creel 36 consist of a support rod 38 having a bearing 30 arranged at its center. Support rod 38 is mounted over vertical pin 26. Opposite ends of support rod 38 have horizontal arms 40 secured thereto. Arms 40 are arranged to be parallel with each other and perpendicular of support rod 38. Opposite ends 40 ' of arms 40 are arranged to extend in a vertical direction and bobbin support studs 34 are secured adjacent ends 40' and are directed inwardly. Opposed pairs of bobbin supports 34 so arranged on ends 40' are each located along a longitudinal axis and the four bobbin supports 34 are arranged along a single horizontal plane. A center line drawn along the axis of one of the bobbin supports 34 also extends along the axis of the opposing bobbin supports 34 as clearly seen in FIG. 2. Supply bobbins D carried on supports 34 are arranged to have a common center axis.

The outer configuration of creel 36 is substantially square. Due to this configuration and because of the length of arms 40 creel 36 is prevented from rotating about pin 26. The outer ends of arms 40 will not clear vertical beams 16 when creel 36 is turned about pivot 30. Thus, creel 36 is limited to an oscillating motion.

There is provided a lower yarn deflector plate 42 which of circular configuration. Deflection plate 42 is formed of a clear plastic material and functions to prevent yarn being drawn from one of bobbins D mounted by creel 28 from becoming entangled. Deflector plate 42 has an opening at its center. In its operative position, plate 42 rests on the upper surfaces of arms 32 with pin 26 extending through its center opening and its periphery being adjacent arm ends 32'. A second lower deflection plate 44 is provided for creel 36. Second deflector plate 44 is structured similar to deflection plate 42 except that its periphery is shaped to be substantially square. This configuration allows an outer edge to be adjacent each of the vertical ends 40' of arms 40. A yarn deflector shield 46 is secured below transverse rods 18, 20 and 22. Each yarn deflector shield 46 is carried by a pair of horizontal support arms 48 which are secured in opposing relationship along the inner surfaces of vertical beams 16. Yarn deflector shields 46 are secured to the undersurface of transverse rods 18, 20 and 22 in a spaced arrangement as provided by spaces 50. Yarn deflector shields 46 also function to prevent yarn being drawn from a bobbin mounted on creels 28 or 36 from becoming entangled. Yarn deflector shields 46 also function to support the yarn delivery system E for each of the creel support areas B and C. Each yarn of similar texture or color delivered from a creel support area requires an individual yarn delivery system E.

Figure 2:
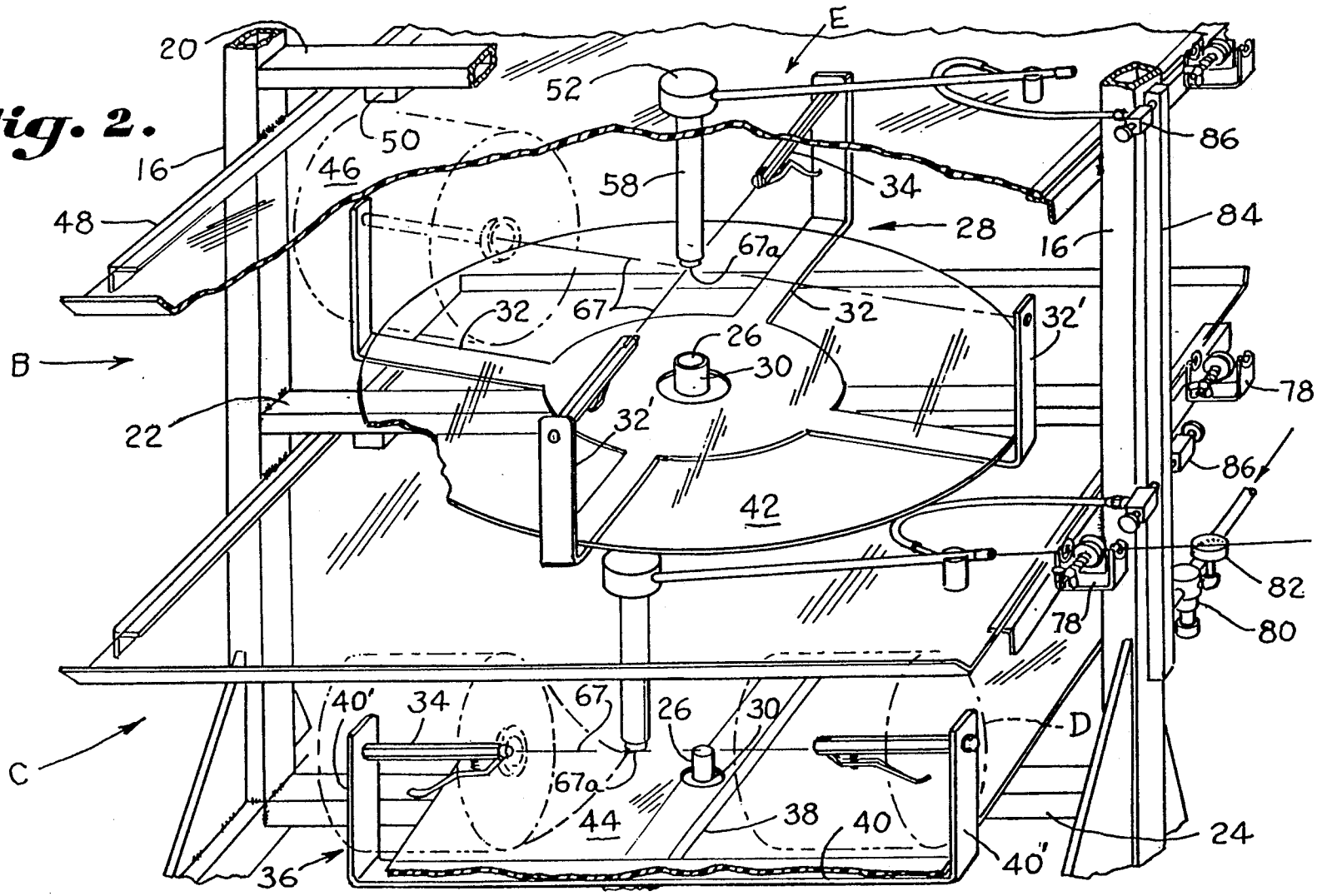
FIG. 2 is a sectional perspective view of the supply system showing structure in greater detail.
Figure 3:
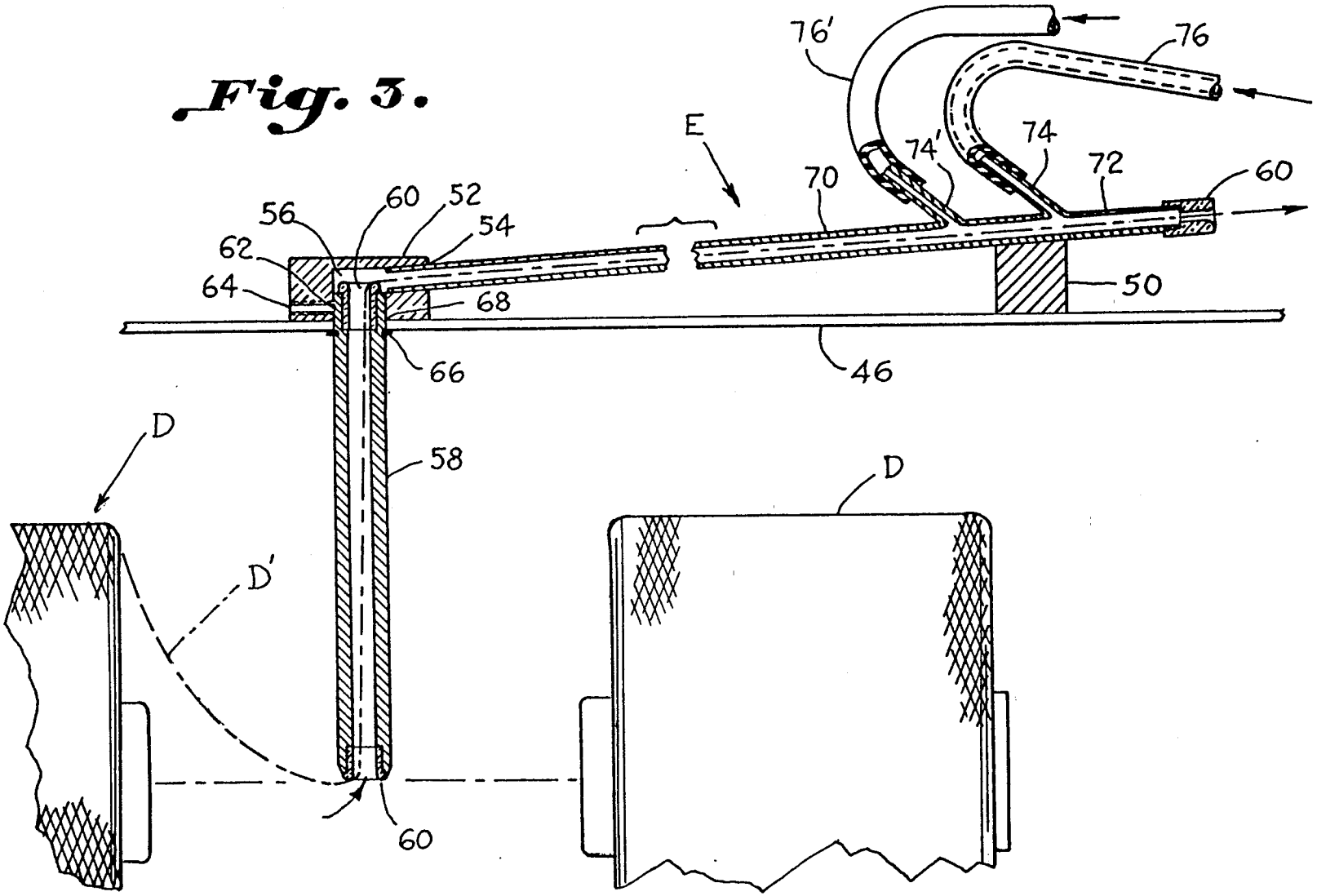
FIG. 3 is a side sectional view of the yarn delivery and threading apparatus.

A pneumatic conduit having a transition section in the form a yarn delivery system E consists of a support housing 52 which is circularly configured as shown in FIGS. 2 and 3. Housing 52 includes a small horizontal bore 54 through a vertical edge and a larger bore 56 through its underside and along its center axis. Bore 54 terminates where it intersects bore 56 at substantially its upper end. The two bores 54 and 56 constitute a through bore passing through housing 52. The pneumatic conduit includes a first tube 58, which is of a diameter slightly less than the diameter of bore 56, adapted to be secured to housing 52. First tube 58 has a wedge shape groove 62 formed adjacent its upper end. A stop ring 66 is provided below but adjacent wedge shaped groove 62. Each end of first tube 58 is provided with a ceramic eyelet 60. The inner surface of ceramic eyelet 60 is located inwardly of the inner surface of tube 58 so that yarn D' when moving through tube 58 never contacts the inner surface of the tube.

To locate a yarn delivery system E with a creel support area B, housing 52 is located on the upper side of a deflector shield 46 with bore 56 arranged over hole 68. The hole 68 is formed along a line drawn through the axis of pin 26. Tube 58 is passed from beneath deflector shield 46, through hole 68 and into bore 56. Wedge shaped groove 62 is aligned with set screw 64 which is arranged in housing 52. Also, stop ring 66 is brought into contact with the lower surface of deflector plate 46. Screw 64 is tightened against the side of wedge shaped groove 62, which due to its shape draws stop ring 66 more snugly against the lower surface of deflector plate 46, to lock housing 52 in position. First tube 58 is of a length that its lower end is positioned along the center line 67 drawn along the axis of each of the bobbin supports 34. The axis of the first tube 58 extends along a line parallel with the axis of pin 26, and intersects the center line 67 of the supply bobbin and supports at 67*a*.

The pneumatic conduit includes a second tube 70 having a first end secured in bore 54 of housing 52. Second tube 70 is arranged to extend at a slight angle to but substantially parallel with, the upper longitudinal surface of deflector shield 46. A second, opposite end of tube 70 of the pneumatic conduit terminates adjacent an edge of creel support area B and is directed toward the fabricating machine being supplied with yarn. A ceramic eyelet 60 is secured to the second end of tube 70. The inner surface of ceramic eyelet 60 is located inwardly of the inner surface of tube 70. As shown in FIG. 3, this arrangement keeps yard D' from coming into contact with the inner surface of tube 70 during operation of the fabricating machine.

It should be noted that a cavity area is formed in the upper end of bore 56 which is above the upper end of tube 58. This cavity allows a yarn extending along the longitudinal axis of tube 70 to have its axis substantially coincide with the upper edge of the ceramic eyelet 60 seated in the end of tube 58.

Tube 70 extends from housing 52 at a slightly elevated angle and is maintained so positioned by having its end 72 supported by block 50. End 72 is directed toward and is adjacent yarn tensioner 78 which is of known structure.

An inlet tube 74 is connected with second tube 70 adjacent end 72. A flexible tube 76 connects inlet tube 74 with a supply of compressed air. The compressed air is normally supplied by a source associated with the loom or other texturizing machine with its primary function being for pneumatic cleaning apparatus or pneumatic weft picking apparatus. Any suitable air supply is satisfactory however. The compressed air is delivered from the texturizing machine to the yarn supply system through pipe 78'. A gauge 82 and a regulating valve 80 are arranged along pipe 78' and connect with storage chamber 84. The storage chamber is designed to contain a specified volume of compressed air at about 20 pounds of pressure. Manual valves 86 are connected with the storage chamber and are also connected with flexible tubes 76 which are associated with each yarn delivery apparatus E. In operation, valve 86 is opened allowing compressed air to pass through flexible tube 76, through inlet tube 74 and into second tube 70. Inlet tube 74 is arranged to intersect with second tube 70 at about a 45° angle so that the compressed air coming out of inlet tube 74 is directed toward and out end 72. The action of the compressed air moving through end 72 creates a venturi effect through first tube 58 and second tube 70 which causes a suction through tubes 58 and 70 which draws air into the first, lower end of tube 58. The force of the suction created by the venturi effect is sufficient to entrain a yarn end held in the vicinity of the lower end of tube 58 and to propel that yarn end through first tube 58, through housing 52 and through second tube 70.

Viewing now FIG. 1 and 3, yarn bobbins D are mounted on supports 34 about the periphery of creel 28. The ends of the bobbing are arranged to face inwardly with their axis being along a common plane. The trailing end of the yarn from adjacent yarn packages D is connected with the leading end of the supply yarn of an adjacent packages so that as the yarn is depleted from one package, the supply shifts to an adjacent package and draw-off continues. This is a well known process as illustrated in U.S. Pat. Nos. 3,693,904 and 4,545,547.

Yarn D' is drawn from a single bobbin readied to be drawn through the yarn delivery apparatus E.

With yarn D' adjacent the first, lower end of tube 58, valve 86 is opened and the yarn end is moved through feed apparatus E. The yarn D' is then threaded through the tensioning device 78 and connected with the drawing in apparatus of the loom. In operation, yarn D' is drawn through delivery apparatus E contacting only eyelets 60. There is no contact with tubes 58 or 70 nor housing 52.

The yarn delivery apparatus E above described is associated with creel support areas B which operate with a single texture or color yarn. Creel support area C which carries multi color or multi texture yarn operates with two yarn delivery apparatus units E. Creel 36 of creel support area C is constructed with a left and right pair of yarn support bobbins D. Each pair of bobbins is mounted by a single arm 40 on opposed vertical ends 40' by supports 34. A longitudinally extending line drawn along the axis of each pair of bobbins extends along a single horizontal plane. Upper deflecting shield 46 arranged beneath horizontal rod 22 is provided with a pair of spaced bores, not shown, one of which is aligned with each of the longitudinal lines extending along the axis of each pair of yarn supply bobbins D. The bores are also arranged centrally of each pair of bobbins D. A yarn delivery apparatus E, as shown in FIGS. 1 and 2, is mounted in each of these holes and operates with a respective pair of supply bobbins D in the manner described above with respect to creel support area C.

A yarn D' from a single bobbin of a pair of bobbins of creel support area C extends through delivery apparatus E and the yarns of the paired bobbins are interconnected to provide continuous yarn supply after the yarn is depleted from the first bobbin as earlier described.

In an alternative arrangement, an auxiliary air line connected with an auxiliary air supply may be provided as shown in FIG. 3. This auxiliary air line consist of a flexible tube 76' connected with an auxiliary inlet tube 74' which is connected with second tube 70 The auxiliary air delivery members 74', 76' act to continuously release a small volume of compressed air through tube end 72 so as to maintain a slight air flow through each of feeding apparatus E. This slight air flow acts to assist in drawing the yarn from bobbins D and through the apparatus E. Another feature of the auxiliary air arrangement is that the continuous flow of air tends to reduce the tension on the yarn being delivered through the delivery apparatus E by acting to maintain the yarn separated from tubes 58 and 70. Because of the sharp angles of the delivery apparatus E this is an important feature when the device is used with high speed looms. It is also advantageous for certain fine yarns which tend to break when pulled off a bobbin during weaving. The device would otherwise operate as previously described.

In operation, a yarn from each creel support area B and C is threaded through yarn delivery device E by pneumatic threading apparatus. The individual yarns D' are threaded through tension members 78 and delivered to the feeding station of the loom or other textile fabricating machine. The yarns D' are then drawn off bobbin D as needed.

Creels 28 are mounted in the creel support areas B to be rotatable. This allows for easy re-supply of creel 28 with fresh weft bobbins D and also allows easy access to the yarn ends.

While a preferred embodiment of the invention has been described using specific terms, such description is for illustrative purposes only, and it is to be understood that changes and variations may be made without departing from the spirit or scope of the following claims.

What is claimed is:

1. A yarn supply system for supplying yarn to a textile fabricating machine comprising:

a frame having a plurality of vertically disposed creel support compartments;

a first creel carrying a plurality of bobbin holders for mounting bobbins of a single color arranged with their axes extending generally horizontally and arranged so that lines drawn along said axes merge at a single point centrally of said first creel;

a second creel carrying a plurality of bobbin holders for mounting bobbins arranged in pairs, each pair of said bobbins carrying yarn of a single color different from the color of the other pair of said bobbins, said pairs of bobbins being arranged with their axis extending along a generally horizontal plane and a longitudinal line drawn along the axis of a first bobbin holder of said first and second pair of bobbins also extends along the axis of the other bobbin holder of said first and second pairs of bobbins;

individual yarn delivery means each having a vertically extending yarn receiving tube, arranged to be associated with each yarn color supported within each creel support compartment, each said yarn delivery means being operative to guide a yarn from said creel support compartment to said fabricating machine; and means provided within each said creel support compartment capable of supporting either said first creel or said second creel whereby said supply system may be arranged to deliver at least two yarns of different color to said texturizing machine from each creel supply compartment.

2. The system of claim I wherein said first and second creels are supported by a frame which includes spaced vertical beams and at least one interconnecting horizontal rod, said first and second creels are mounted above said at least one horizontal rod.

3. The system of claim 2 wherein said first creel is rotatably mounted.

4. The system of claim 2 wherein each of said first and second creels mount a yarn deflector plate.

5. The system of claim 2 wherein each horizontal rod mounts a horizontally disposed yarn deflector shield, said deflector shields act to separate said creel support compartments.

6. The system of claim 1 wherein a yarn deflector shield is arranged above each of said creel support compartments, said yarn delivery means are mounted on said deflector shields with said vertically extending yarn receiving tube being arranged below said deflector shield and the remainder of said yarn delivery means being disposed above said deflector shield.

7. A weft supply system for a loom, said system including:

a support frame having vertically extending support beams interconnected with vertically spaced substantially horizontal rods which form a plurality of vertically aligned creel support levels;

certain of said horizontal rods include creel mounting means;

a multi-bobbin creel mounted within each said creel support level by said creel mounting means;

said weft yarn supply system further includes yarn delivery means mounted above each creel support level; and said yarn delivery means includes a pneumatic threading system for threading said weft yarn through said yarn delivery means.

8. The support system of claim 7 wherein certain of said creels are provided with bobbin support means which support bobbins carrying weft yarn of at least two colors and each weft yarn of a single color is provided an individual yarn delivery means.

9. The system of claim 7 wherein said creel mounting means rotatably mounts certain of said creels and certain other of said creel mounting means mount other of said creels in a non-rotatory manner.

10. The system of claim 9 wherein said creel support levels are separated by a horizontally disposed yarn deflector shield and each said yarn delivery means is mounted above its associated creel by one of said deflector shields.

11. The system of claim 7 wherein each said creel is provided with bobbin support members which are disposed about outer edge areas of said creel, said bobbin support members mount weft yarn supply bobbins to face inwardly.

12. The system of claim 11 wherein first ones of said creels mount four weft yarn bobbins carrying yarn of a single color, said weft yarn bobbins extend along a generally horizontal plane and lines drawn along their axis merge at a center point of said first creels, said delivery means includes a first vertically extending tube having a yarn receiving opening disposed adjacent said center point.

13. The system of claim 11 wherein certain ones of said creels mount four weft yarn bobbins carrying yarn of two colors, bobbin holders mounting said weft yarn supply bobbins carrying yarn of the same color are arranged in pairs to extend along a generally horizontal plane, said pairs of bobbin holders are arranged with their ends in opposed relationship, said delivery means includes a first vertically extending tube having a yarn receiving opening, and arranging said yarn delivery opening of said delivery means between each pair of said bobbins.

14. The system of claim 13 wherein said yarn delivery means associated with said pairs of bobbin holders carrying yarns of matched color include a vertical first tube having a yarn receiving opening, said yarn receiving opening is arranged intermediate said paired bobbin holders and along a line which passes along the axes of said paired bobbin holders.

15. The system of claim 7 wherein said yarn delivery means includes a housing having a through bore, a first vertically extending tube having a second end retained in said through bore of said housing and a first end arranged to receive said yarn;

a substantially horizontally extending second tube which has a first end secured in said through bore and a second end directed toward said loom;

said threading system including means delivering air under pressure into said second tube adjacent said second end, said pressurized air creating suction by a venturi effect through said delivery means capable of drawing a yarn there through.

16. The system of claim 15 wherein a horizontally disposed deflector shield is arranged below certain of said horizontal rods, said deflector shields, act to separate each of said creel support levels.

17. The system of claim 16 wherein each of said deflector shields are provided with openings over which each of said housing of said delivery means is positioned with a lower surface of said housing resting on an upper surface of said deflector shield, a locking ring is provided adjacent said first end of said first tube whereby when said first end of said first tube is positioned through said opening and secured in said housing, said locking ring cooperates with said lower surface of said deflector shield to lock said yarn delivery means in position.

18. The system of claim 15 wherein said first tube of said yarn delivery means is provided with a ceramic eyelet secured in its said first and second ends, and said second tube of said yarn delivery means is provided with a ceramic eyelet secured in said second end, said eyelets functioning as the sole support surface for said yarn passing through said yarn delivery means.

19. A yarn supply system for supplying yarn to a textile weaving machine, said system including:

a creel having means which mount a plurality of bobbin holders for carrying bobbins, said bobbin holders are arranged so that a line passing along the axes said bobbins held thereby intersect at an intersecting point along a vertical axis disposed centrally of said creel and intermediate of said bobbin holders;

yarn delivery means operative to deliver a single yarn from said creel to said weaving machine;

a pneumatic conduit having a first generally vertical tube and a second tube angularly disposed to said first tube, and a transition section connecting said first and second tubes;

said pneumatic conduit having first and second ends at the termination of said first and second tubes respectively;

said first tube is arranged to extend along said vertical axis with said first end terminating substantially at said intersecting point along said vertical axis;

said second tube is arranged so that said second end is disposed to deliver said yarn away from said supply system and to said weaving machine;

said yarn delivery means includes a pneumatic threading means for threading said yarn through said first tube, said transition section and said second tube, said threading means includes an air inlet arranged to merge with said second tube along its length in the vicinity of its second end;

means are provided to connect said air inlet with a supply of pressurized air, whereby delivery of said pressurized air through said air inlet and out said second end of said second tube creates a venturi effect which draws air through said first end of said first tube, through said first tube, through said second tube and out said second end of said second tube with sufficient force to entrain said thread and propel it through said delivery means.

20. The system of claim 12 wherein said means connecting said inlet tube with a supply of pressurized air includes a supply line connected to a regulating supply tank through a valve member whereby actuation of said valve releases a blast of compressed air through said inlet tube and said second end of said second tube.

21. The system of claim 20 wherein a regulating valve controls the pressure of the air in said regulating supply tank.

22. The system of claim 19 wherein the axis of each said bobbin holder is disposed along a horizontal plane.

23. The system of claim 19 wherein said transition section of said yarn delivery comprises a support housing disposed along said vertical axis, said support housing includes a through bore which mounts a second end of said first tube and a first end of said second tube, said second and first ends are angularly disposed.

24. The system of claim 23 including a ceramic eyelet carried in said second end of said first tube having a rounded edge over which said yarn travels.

25. A creel supply system for supplying yarn to a textile fabricating machine comprising:

a frame having a vertical axis and a plurality of vertically disposed creel support compartments arranged along said vertical axis;

a creel arranged within each creel support compartment carrying a plurality of bobbin holders for mounting supply bobbins arranged with their axes extending generally horizontally so that lines drawn along said axes merge at a single point centrally of each said creel along said vertical axis;

individual yarn delivery means associated with each creel support compartment, each said yarn delivery means having a vertically extending yarn receiving tube arranged along said vertical axis, said yarn receiving tube having a yarn receiving end disposed at said single point; and individually controlled pneumatic threading means associated with said yarn delivery means of each creel support compartment, said threading means being operative to pick up and pass through said delivery means a yarn from a supply bobbin to deliver said yarn from said creel support compartment to said fabricating machine.

26. A yarn supply system for supplying yarn to a textile fabricating machine comprising:

a frame having a plurality of vertically disposed creel support compartments;

a first creel carrying a plurality of bobbin supports for mounting bobbins supplying a single yarn mounted within a creel compartment;

a second creel carrying a plurality of bobbin holders for mounting bobbins arranged in pairs, mounted within a creel compartment, each pair of said bobbins carrying yarn different from the yarn carried by the other pair of said bobbins;

means mounting said first and second creels within said creel support compartments;

individual yarn delivery means, each having a vertically extending yarn receiving tube, arranged to be associated with each yarn supported within each creel support compartment, each said yarn delivery means being operative to guide a yarn from said creel support compartment to said fabricating machine;

said bobbin supports of said first creel being arranged to support said bobbins so that their central axes and said axis of said associated yarn receiving tube intersect at a common point;

said bobbin supports of said second creel being arranged to support said pairs of bobbins so that their central axes and a longitudinal axis of said yarn receiving tube associated with each pair of bobbins intersect at a common point; and said mounting means including means for supporting either said first creel or said second creel whereby said supply system may be arranged to deliver one or two yarns to said fabricating machine from each creel supply compartment.

27. The system of claim 26 wherein said first and second creels are supported by a frame which includes spaced vertical beams and interconnecting horizontal rods mounting said first and second creels.

28. The system of claim 27 wherein said first creel is rotatably mounted.

29. The system of claim 27 wherein each of said first and second creels mount a yarn deflector plate.

30. The system of claim 27 wherein each horizontal rod mounts a horizontally disposed yarn deflector shield, said deflector shields act to separate said creel support compartments.

31. The system of claim 26 wherein a yarn deflector shield is arranged above each of said creel support compartments, means for mounting said yarn delivery means on said deflector shields with said vertically extending yarn receiving tube being arranged below said deflector shield and the remainder of said yarn delivery means being disposed above said deflector shield.

32. A method of delivering yarn from a yarn delivery system to a weaving machine comprising:

providing at least one creel chamber;

providing a plurality of yarn holders, which support supply bobbins within each chamber;

providing delivery means for a single yarn from each said chamber;

threading said single yarn through said delivery means by creating an air suction of a first velocity within said delivery means and engaging a free end of each said single yarn in said air suction to be drawn through said delivery means;

delivering said threaded yarn to said weaving machine while causing said air suction to continuously be drawn through said delivery means at a lesser second velocity, said second velocity acting to assist in the drawing of said yarn through said delivery means during normal operation of said weaving machine.

33. The method of claim 32 including providing a plurality of vertically spaced creel chambers and providing at least one delivery means for each creel chamber.

* * * * *